United States Patent [19]

Ausnit

[11] 3,987,580

[45] Oct. 26, 1976

[54] SEPARABLY CONNECTIVE FLEXIBLE TOY

[76] Inventor: Steven Ausnit, 124 E. 61st St., New York, N.Y. 10035

[22] Filed: July 17, 1975

[21] Appl. No.: 596,645

[52] U.S. Cl. ..... 46/25; 24/201 C
[51] Int. Cl.[2] ..... A63H 33/08
[58] Field of Search ..... 46/25, 26, 30, 31; 24/201 C

[56] References Cited

UNITED STATES PATENTS

| | | | |
|---|---|---|---|
| 2,354,485 | 7/1944 | Slaughter | 46/30 |
| 2,756,172 | 7/1956 | Kidd | 24/201 C |
| 2,869,692 | 1/1959 | Hassett | 46/25 |
| 3,003,260 | 10/1961 | Bassetti | 46/30 |
| 3,049,779 | 8/1962 | Ausnit | 24/201 C |
| 3,430,329 | 3/1969 | Ausnit | 24/201 C |
| 3,921,312 | 11/1975 | Fuller | 46/30 |

*Primary Examiner*—Louis G. Mancene
*Assistant Examiner*—Robert E. Cutting
*Attorney, Agent, or Firm*—Hill, Gross, Simpson, Van Santen, Steadman, Chiara & Simpson

[57] ABSTRACT

A separably connective flexible toy comprising a plurality of generally flat geometric flexible toy members each of which has a plurality of edges, each of the edges having resiliently flexible interhooking rib and groove separable fastener means therealong, the fastener means being complementary along all of the edges of the members, and being easily pressed together into interhooked relation for connecting the members to one another and being easily separable to disconnect the members from one another.

The members may be made up from extruded sections formed from synthetic plastic material, or they may be directly molded.

14 Claims, 29 Drawing Figures

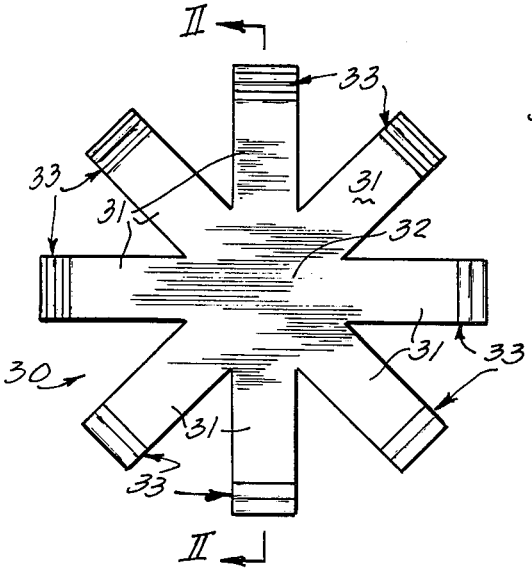
Fig. 1
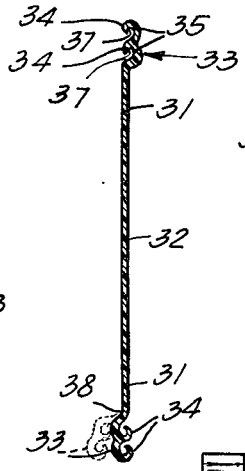
Fig. 2
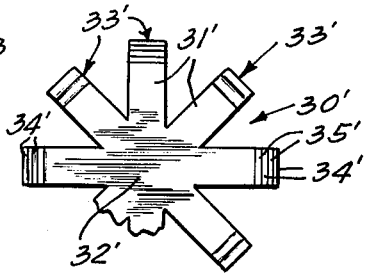
Fig. 3
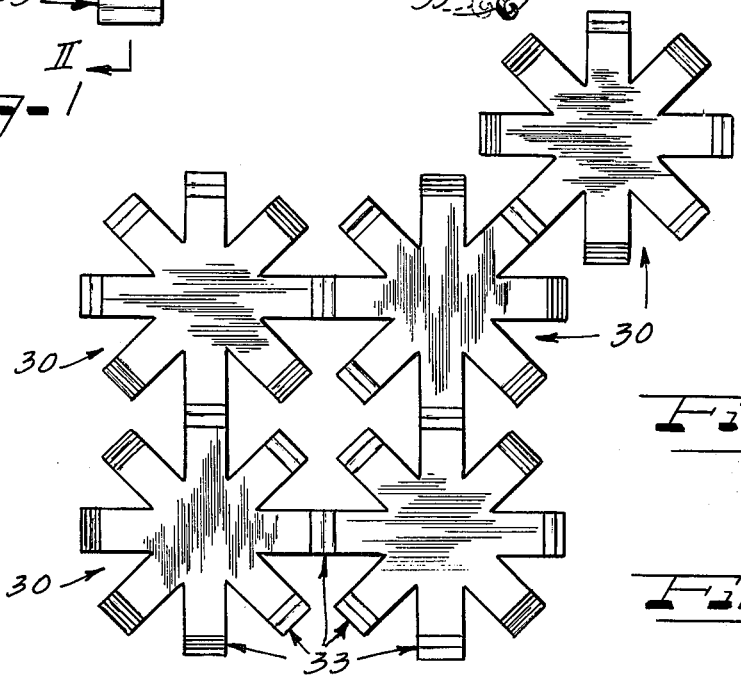
Fig. 4
Fig. 2A
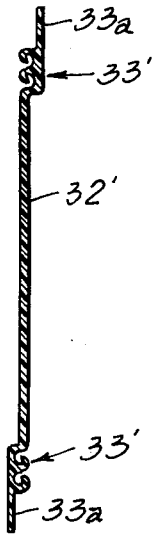
Fig. 5
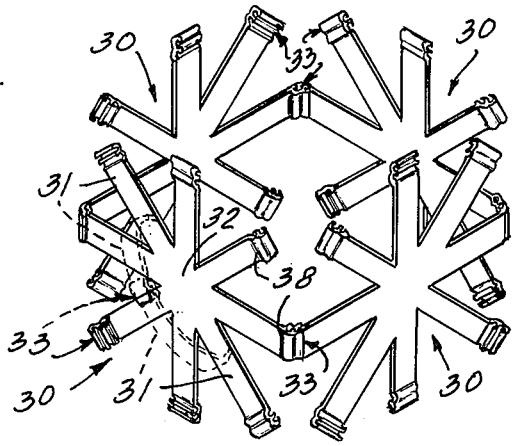

Fig. 6
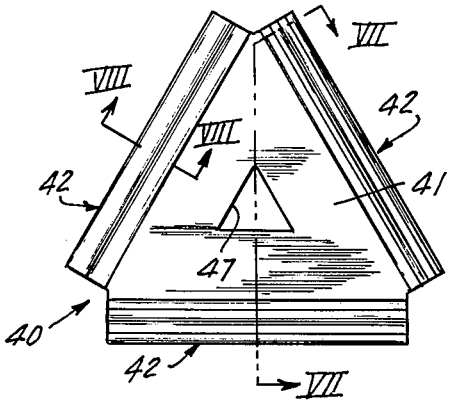
Fig. 7
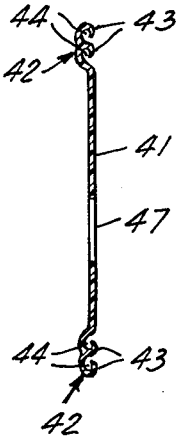
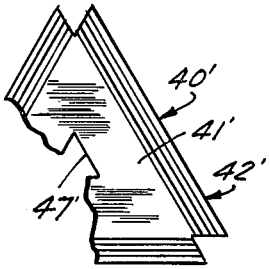
Fig. 9
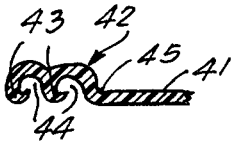
Fig. 8
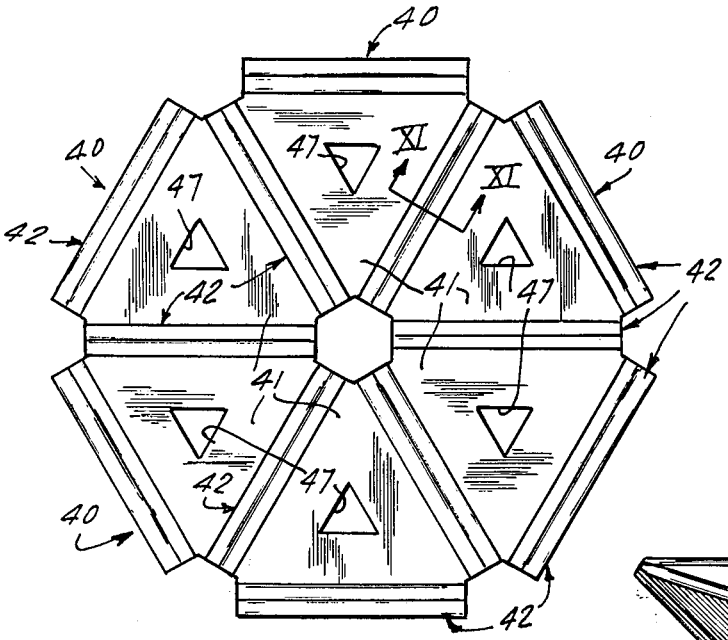
Fig. 10
Fig. 12
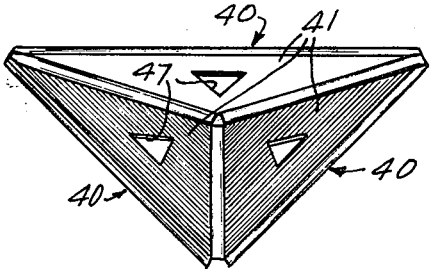
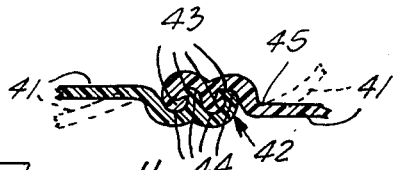
Fig. 11
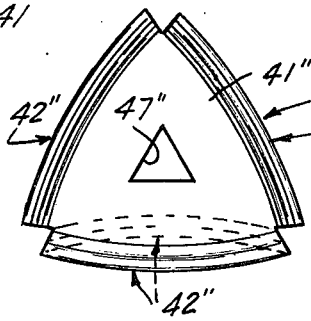
Fig. 13

Fig. 14
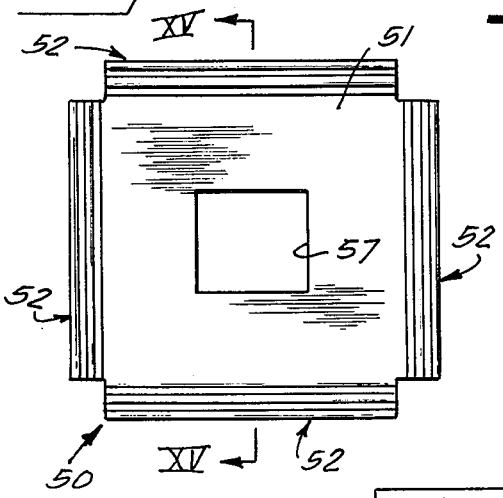
Fig. 15
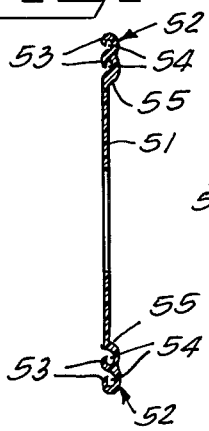
Fig. 16
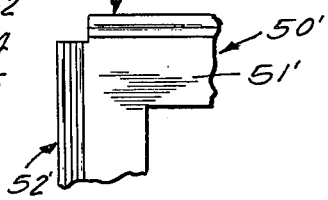
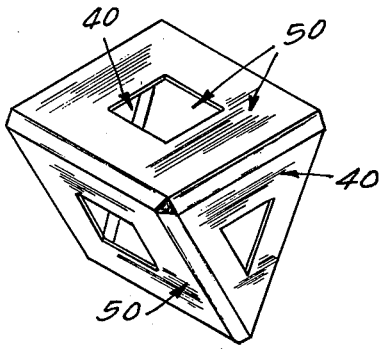
Fig. 17
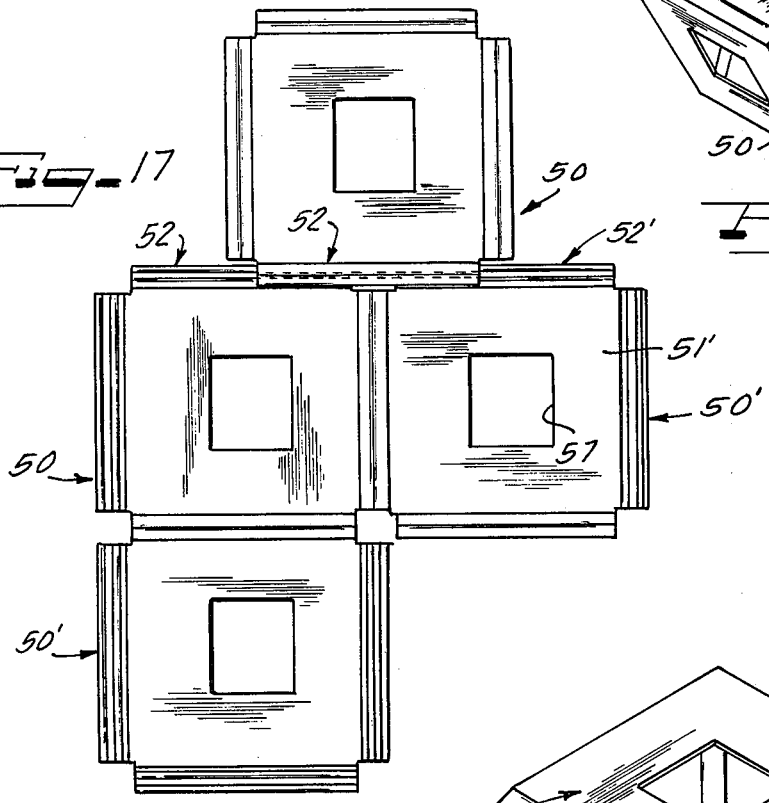
Fig. 19
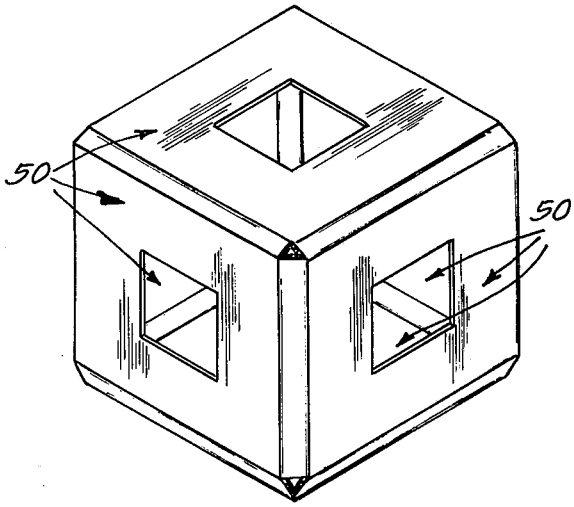
Fig. 18

Fig. 20
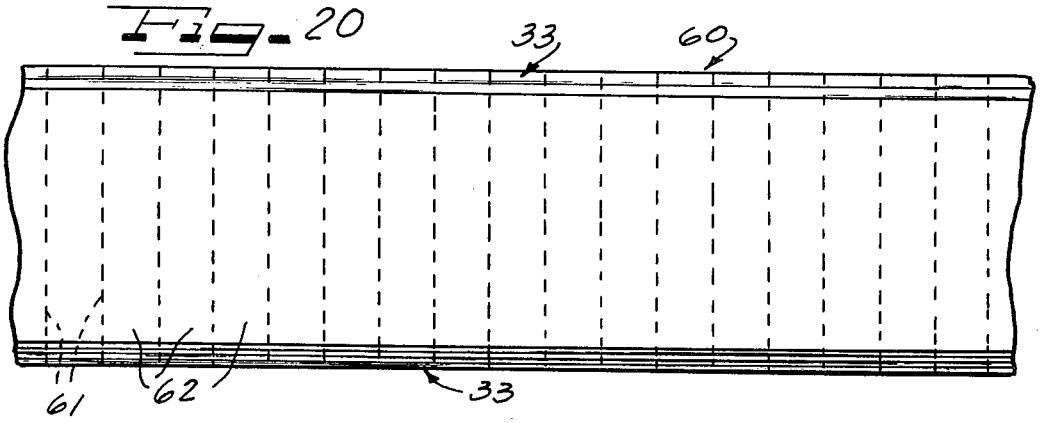
Fig. 21
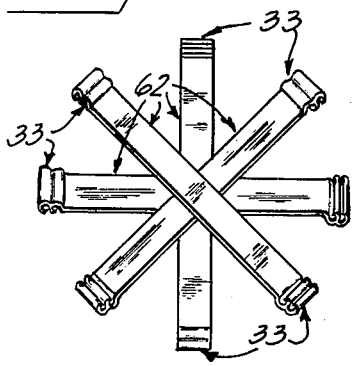
Fig. 23
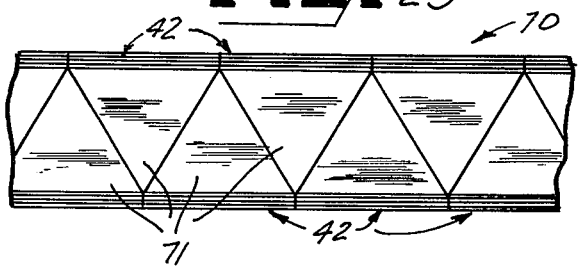
Fig. 22
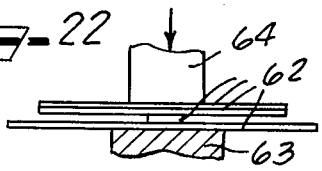
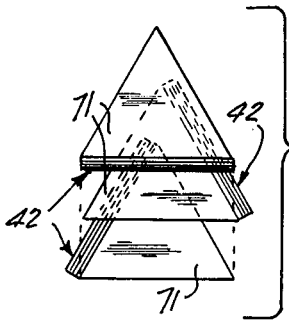
Fig. 24
Fig. 27
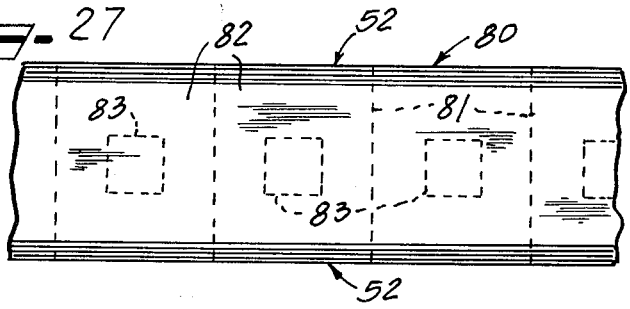
Fig. 25
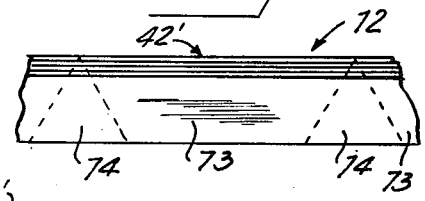
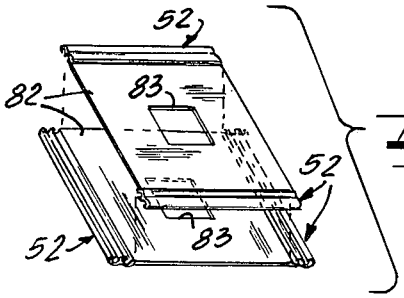
Fig. 28
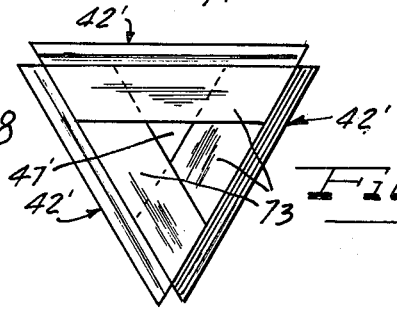
Fig. 26

SEPARABLY CONNECTIVE FLEXIBLE TOY

This invention relates in general to toys and is more particularly concerned with separably connective flexible toys.

Numerous and varied toys have heretofore been proposed or provided, generally of a rigid or semi-rigid construction and having various means for separable connection. Various materials have been used in prior toys, including various plastics. Some toys have required application thereto of special connecting means. Other toys have had integral connecting means generally requiring special, and often several forming dies, special machining, and the like. Insofar as I am aware, no prior toy has been constructed from flexible, molded or sheet-like extruded material carrying integral fastener means on each edge of the toy members, which can be easily pressed together for connecting the toy members together and which can be easily separated to disconnect the members from one another, in a large variety of combinations.

It is, accordingly, an important object of the present invention to provide new and improved separably connective flexible toys and method of making the same.

Another object of the invention is to provide separably connective separable toys which are provided with rib and groove fastener means which are easily pressed together into retaining engagement and can be readily separated to disconnect the members from one another.

A further object of the invention is to provide a new and improved flexible toy which can be produced in a large variety of geometric shapes.

A still further object of the invention is to provide a new and improved flexible toy whose members can be readily connected to themselves or to one another to produce a wide variety of combinations, in a flat plane or in a three dimensional structure.

According to features of the invention a separably connective flexible toy is provided comprising a plurality of generally flat geometric flexible toy members each of which has a plurality of edges, such edges having resiliently flexible interlocking rib and groove separable fastener means therealong, the fastener means being complementary along all of the edges of the members, and the ribs and grooves of the fastener means being easily pressed together into interhooked relation for connecting the members to themselves or to one another and being readily separable to disconnect the members from one another. The flexible toy members are adapted to be economically produced by molding or from extruded plastic sections.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure, and in which:

FIG. 1 is a plan view of a toy member embodying features of the invention;

FIG. 2 is a sectional view taken substantially along the line II—II of FIG. 1;

FIG. 2*a* is a sectional view similar to FIG. 2 but showing a modification;

FIG. 3 is a plan view of a modified form of the toy member;

FIG. 4 is a plan view of a plurality of the toy members connected together in a generally coplanar or two-dimensional relationship;

FIG. 5 is an isometric view showing a plurality of the toy members connected together in a three-dimensional relationship;

FIG. 6 is a plan view of a toy member embodying features of the invention and showing a different geometric configuration;

FIG. 7 is a sectional detail view taken substantially along the line VII—VII of FIG. 6;

FIG. 8 is an enlarged fragmentary sectional detail view taken substantially along the line VIII—VIII of FIG. 6;

FIG. 9 is a modified configuration of a generally triangularly shaped toy member of the type illustrated in FIG. 6;

FIG. 10 is a plan view of a two-dimensional assembly of toy members of FIG. 6;

FIG. 11 is an enlarged fragmentary sectional detail view taken substantially along the line XI—XI of FIG. 10;

FIG. 12 is a three-dimensional assembly of the generally triangular toy members of FIG. 6;

FIG. 13 is a plan view of a further modified generally triangular toy member;

FIG. 14 is a plan view of a generally square toy member configuration embodying features of the invention;

FIG. 15 is a sectional detail view taken substantially along the line XV—XV of FIG. 14;

FIG. 16 is a fragmentary plan view of a modified generally square toy member;

FIG. 17 is a two-dimensional assembly of toy members of the form of FIGS. 14 and 16;

FIG. 18 depicts a generally cubical assembly of toy members of FIG. 14;

FIG. 19 depicts a three-dimensional assembly of a combination of the toy members of FIGS. 6 and 14;

FIG. 20 is a fragmentary plan view of an extruded blank from which separably connective flexible toy members such as represented in FIGS. 1 and 3 are adapted to be made;

FIG. 21 is a plan view showing how elements derived from the blank of FIG. 20 may be assembled to produce the toy of FIGS. 1 and 3;

FIG. 22 is a fragmentary elevational view illustrating how the toy elements assembled as in FIG. 21 may be secured together;

FIG. 23 is a fragmentary plan view of an extruded blank from which elements are derived for producing the flexible toy of FIG. 6;

FIG. 24 is an assembly view showing how elements derived from the blank of FIG. 23 can be assembled to produce the toy member of FIG. 6;

FIG. 25 is a plan view of an extruded blank from which elements are derived to produce the toy member shown in FIG. 9;

FIG. 26 shows how the elements of FIG. 25 can be assembled to produce the toy member;

FIG. 27 is a fragmentary plan view of an extruded blank from which elements are derived for producing the toy member of FIG. 14; and FIG. 28 is an assembly view showing how elements derived from the blank of FIG. 27 may be put together to produce the toy member.

A variety of different forms or modifications of the present invention have been depicted as representative, but it will be appreciated that the principles of the invention may be embodied in still other geometric forms, modifications, patterns, and permutations in view of the versatility of the simple, unique structural features of the separably connective flexible toy and the new and improved method of making the same.

FIGS. 1–5 are representative of generally star-shaped geometric forms according to the invention. Each star-shaped toy member 30 (FIG. 1) may have as many generally radial projections or arms 31 as desired within the limits of separably connective feasibility. In the illustrated instance there are eight of the arms 31 equidistantly circumferentially spaced and radiating from a central body 32. The generally flat geometric toy member 30 is made from a suitable flexibly resilient material, desirably comprising a synthetic thermoplastic such as polyvinyl chloride or polyethylene, which can be readily molded or extruded.

Along each of the edges of the toy member 30 incorporating the arms 31 are provided resiliently flexible interlocking rib and groove separable fastener means 33 by which a plurality of the toy members can be easily connected to one another to provide various toy configurations and can be disconnected at will. For this purpose, each of the fastener means 33 comprises at least one, but preferably a plurality in the illustrated instance two, fastener ribs 34 and complementary grooves 35, which extend parallel to the respective edges. Each of the fastener ribs 34 is of generally hook-like profile providing an undercut tooth facing into the contiguous groove. Through this arrangement, the fastener means 33 can be easily pressed together into interlocked relation for connecting a plurality of the members 30 to one another and are separable for disconnecting the members from one another, by moving the interlocked members in opposite directions so that they slide by each other. That is, by placing that fastener means areas 33 of any two of the members 30 into fastening registration of the complementary ribs and grooves and pressing the thus registered fastening areas together, the resiliently flexible hook-like ribs 34 will readily deform and drop into the complementary grooves 35 wherein the ribs assume their unrestrained configuration and become interlocked at the undercut teeth 37. Depending on the resilient stiffness of the material, and the dimensions of the ribs and grooves, the interlocked engagement will persist with substantial resistance to pulling apart separation, so that the toy members 30 will be effectively held together in the preferred connected orientation. However, when it is desired to disconnect the members 30 from one another, the ribs and grooves of the fastener means areas 33 can be separated by moving one interlocked member in one direction and the other member in the opposing direction, thereby sliding them past each other into a disengaged mode. Another method of separation can be provided by attaching an integrally formed opening lip 33*a* as in FIG. 2*a* to the edge of the fastening area 33' and using this lip to peel apart the interlocking ridges from the grooves containing them. These methods of engagement and disengagement allow the fastening means 33, 33' to be securely interlocked yet remain relatively flat and have an engaged thickness of under 100 mils.

In one preferred form, each of the arms 31 in longitudinal alignment with one another have the ribs 34 and grooves 35 of their respective fastener areas 33 facing toward the respective opposite faces of the toy member 30. Although the facing orientation of the fastener areas 33 may be alternated about the circumference of the member 30, they may be oriented in any other preferred arrangement, such as shown wherein four of the adjacent areas 33 face in one direction and the remaining four adjacently located areas face in the opposite direction.

Although the arms 31 may be thin and easily flexible, the fasteners 33 are preferably of a stiffer resilient flexibility to enhance the interlocking retention of the ribs 34 in the grooves 35. This relative stiffness relationship provides a resilient hinge 38 at juncture of each of the fastener areas 33 with its associated arm 31, permitting relative hinging movement of the fastener area as represented by the dash outline in FIG. 2.

Instead of having the ribs and grooves of the fastener areas 33 of the aligned arms facing in respectively opposite directions, the fastener areas may be oriented to face in the same direction as represented in FIG. 3 wherein the generally flat geometric flexible toy member 30' has arms 31' radiating from a body 32' and along the edges provided by the arms 31' has respective fastener means areas 33' in which the interlocking ribs 34' and grooves 35' face in the same direction, that is toward the same face plane of the member 30' on each of the aligned arms 31'. Although the arrangement may be such that all of the ribs and grooves face in the same direction, any other preferred relationship may be provided such, for example, as shown wherein the fastener areas 33' are alternately reversed circumferentially about the member 30'.

Various toy configurations can be constructed by fastening a plurality of the toy members together, a two-dimensional arrangement being depicted in FIG. 4 wherein a plurality of the toy members 30 have been interconnected. It will be understood that similar toy configurations can be produced with the toy members 30'. By virtue of the hinged connection of the fastener areas 33 to the arms 31, various three-dimensional configurations can be attained by connection of the members 30 to one another, as represented in FIG. 5 where a generally cubical configuration is shown. This configuration can be expanded to provide a ring or spherical shaped configuration having more than four of the members 30.

Various pleasing effects can also be attained by bending the aligned arms 31 of the member 30 toward one another and securing the fastener means 33 thereof together, as depicted in dash outline in FIG. 5 wherein two of the arms 31 are looped over the body 32 and fastened to the other. If desired any remaining two aligned arms 31 may be looped over the connected arms and fastened together. Other ornamental effects can be attained by, for example, interlooping the connected arms loops of a plurality of the members 30.

In FIGS. 6–13 separably connective flexible toy configurations involving generally triangular basic units are provided represented by the toy member 40 in FIG. 6, the toy member 40' in FIG. 9, and the toy member 40'' in FIG. 13 as examples of this geometric configuration. The toy member 40 is shown as having a generally flat body 41 of regular triangular outline provided along each of its three edges with a respective fastener means area 42 having generally hook-shaped profile fastener ribs 43 and contiguous complementary grooves 44 (FIGS. 7 and 8) adapted to receive the ribs of another of the members 40 in interlocked relation (FIGS. 10 and 11). By virtue of flexible hinge connection 45 of the fastener areas 42 with the member bodies 41, three-dimensional connection of the members 40 may be effected as depicted in FIG. 12, as well as the two-dimensional arrangement represented in FIG. 10. Relatively easy pressure coupling of the fastener areas 42 is afforded similarly as described in connection with the embodiments of FIGS. 1–5. Separation is effected by peeling apart the fastener areas from their free ends or as indicated in FIG. 2*a*.

While in one preferred arrangement, the opposite ends of the fastener areas 42 are substantially squared off as shown in FIG. 6, a generally dove tail slightly elongated arrangement of the fastener end areas 42' along the edges of the body 41' of the member 40' may be provided as shown.

Instead of having the sides of the member 40'' straight as in the members 40 and 40', an arcuate formation of the edges of the body 41'' may be provided, wherein the interhooking rib and groove fastener areas 42'' along the edges follow the same arcuate contour. To enable attaching one of the members 40'' to another of the members 40'', every alternate one of the members to be attached must have the connective fastener areas 42'' complementally oppositely arched, that is where one is convexly curved as shown in full outline, the other must be concavely curved as represented in dash outline.

To provide more interesting appearance, the bodies, 41, 41' and 41'' may be provided with interesting ornamental treatment which may be embossed or, as shown, perforated therein, herein shown as an ornamental, in this instance triangular opening 47 in FIG. 6, 47' in FIG. 9 and 47'' in FIG. 13.

FIGS. 14–18 depict a separable connective flexible toy embodying substantially rectangular, in this instance square, toy members 50 each of which comprises a body 51 having along its edges resiliently flexible interlocking rib and groove separable fastener means areas 52. Each of the fastener areas 52 has hook shaped profile ribs 53 and contiguous complementary rib-receiving interlock grooves 54. A resiliently flexible hinge juncture 55 is provided between each of the fasteners 52 and the body 51. As shown in FIG. 14 the fastener areas 52 may all have the ribs and grooves facing toward one face of the toy member 50, or as shown in FIG. 16 one or more of the fastener areas may be reversed so that the toy member 50' has along the edges of the body 51' rib and groove fastener means areas 52' in which the ribs and grooves face is alternately opposite directions.

The members 50, or 50', as the case may be, may be connected together through interlocking of the fastener areas 52 or 52' to produce various two-dimensional arrangements wherein the toy members may be aligned or relatively offset as preferred. Where a pair of the members 50, 50' are aligned, another of the members 50 may be connected thereto as shown at the top of FIG. 17 with one of its fastener areas 52 spanning between and connected to the aligned fastener areas of the aligned members. By virtue of hinge connections 55 between the fastener areas 52 and the body 51 of the member 50, three-dimensional toy configurations are readily built up as shown in FIG. 18 where a generally cubical shape is shown and wherein all of the contiguous edges of the members 50 are fastened together by means of the pressure interlocking fastener means 52. For ornamental purposes and to facilitate manipulation, the members 50 may be provided with apertures 57 in the body 51. These apertures also have a functional purpose in that they provide a means of getting behind the fastener areas inside the closed shapes such as shown in FIGS. 18 and 19 to permit the application of the closing pressure required from both sides of the fastener areas so as to press the ribs and grooves into interlocking relationship.

Interesting and varied toy configurations are attainable by combining the various basic unit members. For example, in FIG. 19 there is shown combination of the generally triangular toy members 40 and generally rectangular toy members 50 to produce a three-dimensional toy configuration. Of course, larger and more complex three-dimensional figures can also be built by using more members.

Economical mass production of the various toy members may be by forming the members from extruded sections of the thermoplastic material. For example, the toy members 30 and 30' of FIGS. 1 and 3 may be constructed from sections derived from a continuous extruded blank 60 having the fastener means 33 formed continuously along opposite edges of the continuous web of the blank. To produce the toy member, the extruded blank 60 is severed along parallel lines 61 to produce strips 62 each of which has one of the fastener areas 33 at each opposite end, and said fastener areas may face in the same direction or in opposite directions. Although the strips 62 may be used of themselves as toy members to be assembled with other like toy members or with other geometric forms of toy members, and in a kit having a selection of toy members where there may be a number of the strips 62, assembling of the strips 62 as elements to form parts of respective toy members 30, in the manner depicted in FIG. 21 is an important and generally predominant use for the strips 62. In this method of making the members 30, the desired plurality of the strips 62 is assembled in crossing relation as shown and with the strips uniformly spaced circumferentially, but the center portions of the strips disposed in laminar relation. Then, by electronic or heat welding technique as depicted in FIG. 22, the overlapping central portions of the strips 62 are fused together between an anvil 63 and a fusing head or die 64 which presses the assembly against the anvil 63 while applying the fusing heat. The end result is the toy member 30.

In similar method, the toy members 40 are efficiently produced from an extruded plastic strip 70 (FIG. 23) which has the rib and groove fastener means 42 along each longitudinal edge so that when the extruded web strip 70 is severed into generally triangular elements 71, each of the elements will have a section of the fastener means 42 along one edge. Then, by assembling the sectional elements 71 in superposed, laminar relation, with one of the fastener areas 42 along each side of the triangular assembly, and bonding the elements 71 as by fusing into a single member, the triangular member 40 is the result. Before assembly of the element 71, or after the assembly has been completed, the hole 47 may be punched therein.

To make the toy member 40' of FIG. 9, the method steps represented in FIGS. 25 and 26 may be followed. For this purpose, a continuous thermoplastic strip 72 is extruded having along one longitudinal edge the fastener means 42'. The strip blank 72 is severed at predetermined intervals into sectional elements 73 by removing suitable triangular portions 74 having an apex at the fastener means edge of the strip, thereby providing the sections 73 with convergently oblique opposite ends as shown. Then, by assembling three of the sectional elements 73 in the manner depicted in FIG. 26, with the fastener means 42' along the outer edges of the triangular assembly, and bonding the overlapping flat end portions of the elements 73 to one another as by fusing them together, the resulting object is one of the toy members 40' wherein the central opening 47' may be automatically formed within the outline of the three section configuration.

To the same effect, making of the separably connective flexible toy member 50' of FIG. 16 may involve the use of the extruded strip blank 72 which for this purpose will be cut into sectional elements along lines normal to the axis of the strip blank so that four of the square end elements with the fastener means along the outer edges of the rectangular assembly, may be suitably oriented in lapping relation at their ends and then said lapping end portions being bonded together as by fusing to produce the unitary member 50'.

Production of the separably connective flexible toy member 50 may be effected by employing substantially the same method, as represented in FIGS. 27 and 28. A continuous strip blank 80 of the plastic material is extruded and provided along both longitudinal edges with the fastener means 52. The strip blank is then severed along severence lines 81 into uniform sections 82 of a width substantially the same as the distance between the inside edges of the fastener means areas 52. Before, simultaneously with, or after severing along the lines 81, central portions of the sections 82 may be punched out as indicated at 83 to produce the opening 57 in the finished member 50. By assembling pairs of the elements 82 into superposed laminar relation as represented in FIG. 28, with the severed edges of the elements 82 along the insides of the fastener means areas 52 of the companion element in each instance, and bonding the elements together as by fusing, the completed member 50 will be provided wherein each edge of the member will have one of the fastener means areas 52. All of the ribs and grooves 53 and 54 may be oriented toward one face of the member or by relatively reversing the elements 82 before fusing them together, the fastener areas 52 along two opposite edges may face one direction and the other two areas 52 may face in the opposite direction. In the completed member 50, the preformed openings 83 in the elements 82 will register in alignment to provide the opening 57 in the member 50. If preferred, of course, the opening 57 may be omitted, or it may be punched in the member 50 after assembly of the elements 82 has been effected.

It will be understood that for fusing the elements 71 of FIG. 24, or the elements 73 of FIG. 26, or the elements 82 of FIG. 28, similar electronic or heat sealing apparatus such as the apparatus 63, 64 of FIG. 22 may be employed, suitably dimensioned to accommodate the particular geometric configuration of the member being made.

In order to produce the toy member 40'' of FIG. 13 substantially similar method steps as described in connection with FIGS. 25 and 26 may be employed except that the strip blank from which elements are derived for building up the member will be extruded in a generally helical form to provide the convex or concave fastener means edges on the elements to provide the corresponding curved shape for the edges of the member 40''.

From the foregoing it will be apparent that the present invention provides a unique toy capable of numerous and varied geometrical configuration embodiments wherein individual separably connective flexible toy members of various geometric shapes will provide two or three-dimensional forms by connecting the same geometric shapes to one another or by mixing various shapes in a built-up form. By selection of various colors for the basic toy member units monochromatic or multi-color basic toy members or units may be produced, and by provision of different colors in different member units varicolored assemblies can be produced. Although a few representative assembled forms have been depicted, numerous and varied other forms can be made up according to the ingenuity of the user. The toy provides not only an interesting amusement device for pure pleasure, but also provides an educational device such as for various learning activities by providing manual dexterity training, perceptual differentiation training, artistic ability and imagination development. It may serve as a device for therapeutic activity.

It will be understood that variations and modifications may be effected without departing from the spirit and scope of the novel concepts of this invention.

I claim as my invention:

1. A separably connective flexible toy, comprising: a plurality of generally flat geometric flexible toy members with each toy member having a plurality of radial arms each of substantially uniform width along its length with complementary fastener rib and groove fastener means at the distal end of each arm, each of said arms being bendable and twistable along its length, said fastener ribs and grooves of the arm ends interlockable with fastener ribs and grooves of another arm end of the same member or of another member being easily pressed together into interlocked relation and being readily separable to connect and to disconnect the members from one another or the arm ends from each other.

2. A toy according to claim 1, wherein each of said members including its fastener means comprises at least one extruded section formed from synthetic plastic material.

3. A toy according to claim 1, wherein each of said members comprises a plurality of bonded laminations each of which provides an edge of the member having said rib and groove fastener means therealong.

4. A toy according to claim 1, wherein said toy members are of generally four-sided shape and said edges with said fastener means are disposed in angular relation to one another.

5. A toy according to claim 1, wherein said members are of different geometric shapes, and the fastener means of the members are freely interlockable to interlock the differently shaped members with one another.

6. A flexible toy according to claim 1, wherein the ribs of said separable fastener means are of generally hook-shaped cross section and said grooves are complementary to said ribs and have surfaces in common therewith.

7. A toy according to claim 1, wherein the toy members have generally imperforate flexible bodies.

8. A toy according to claim 1, wherein said fastener means can be interlocked in both a two dimensional plane structure and a three dimensional structure.

9. A toy according to claim 1, wherein said fastener means on the member can be interlocked either to themselves or in a two dimensional structure or in a three dimensional structure.

10. A toy according to claim 1, wherein said fastener means are interlocked by pressing the ribs of one member into the grooves of another member and are separated by moving said members in opposing lateral directions so that they slide past each other into unlocked relationship.

11. A toy according to claim 1, wherein said fastener means are interlocked by pressing the ribs of one member into the grooves of another member, and lifting lip means are provided integrally attached along the outer edges of the fastener means to facilitate separation of the fastener means.

12. A toy according to claim 1, wherein said fastener means are of a flat configuration of under 100 mils when in interlocked relationship.

13. A toy according to claim 1, wherein the members have openings between the fastener means thereof to facilitate access to the said fastener means for interlocking of said fastener means.

14. A separably connective flexible toy, comprising: a plurality of generally flat geometric flexible toy members with each toy member having a plurality of radial arms with ribs and grooves located at the arm ends and each of said arms being bendable and twistable along its length, said ribs and grooves being on arms which are located at substantially diametrically opposed positions facing in opposite directions so that opposite arms may be bent toward each other to interlock at their ends, said ribs and grooves being complementary shaped and being easily pressed together into interlocking relation for connecting the members to one another or for interconnecting the arms and being readily separable to disconnect the members from one another or to disconnect the arms.

* * * * *